US005421637A

United States Patent [19]

Lemburg

[11] Patent Number: 5,421,637

[45] Date of Patent: Jun. 6, 1995

[54] FOLDABLE STADIUM SEAT AND STORAGE APPARATUS

[76] Inventor: Timothy R. Lemburg, 695 Rose Rd., Dannebrog, Nebr. 68831-3120

[21] Appl. No.: 175,128

[22] Filed: Dec. 29, 1993

[51] Int. Cl.[6] ..... A47C 7/62

[52] U.S. Cl. ..... 297/188.01; 297/183.6; 297/129; 297/378.1; 297/DIG. 6

[58] Field of Search ..... 297/17, 118, 129, 183, 297/188, 192, 193, DIG. 6, 217, 189, 252, 352, 250.1, 190, 191, 378.1; 190/8

[56] References Cited

U.S. PATENT DOCUMENTS

| | | | |
|---|---|---|---|
| D. 258,178 | 2/1981 | Bayne . | |
| 365,326 | 6/1887 | Abramson | 297/191 X |
| 936,502 | 10/1909 | Wilcherling et al. | 297/252 |
| 2,740,466 | 4/1956 | Du Priest | 297/183 |
| 2,865,433 | 12/1958 | Warner | 190/8 X |
| 3,088,771 | 5/1963 | Weigle | 297/190 X |
| 3,092,224 | 6/1963 | O'Neil | 297/183 X |
| 3,120,404 | 2/1964 | Bramming | 297/188 |
| 3,580,633 | 5/1971 | Du Priest | 297/188 X |
| 3,594,039 | 7/1971 | Harp | 297/252 |
| 3,627,086 | 12/1971 | Caigan | 190/8 |
| 3,763,972 | 10/1973 | Karzmar | 190/8 |
| 3,817,574 | 6/1974 | McNab | 190/8 X |
| 4,387,924 | 6/1983 | Fernandez | 297/188 |
| 4,556,250 | 12/1985 | Chapman et al. | 297/192 |
| 4,715,652 | 12/1987 | Ward . | |
| 4,781,413 | 11/1988 | Shumack, Jr. . | |
| 4,783,120 | 11/1988 | Kiechlin | 297/250.1 X |
| 4,799,731 | 1/1989 | Brown | 297/192 |
| 4,843,662 | 7/1989 | Handelman | 297/183 X |
| 4,854,637 | 8/1989 | McCree | 297/188 |
| 4,871,209 | 10/1989 | Handelman . | |
| 5,067,771 | 11/1991 | Ellis . | |

FOREIGN PATENT DOCUMENTS

| | | | |
|---|---|---|---|
| 1567682 | 5/1969 | France | 297/191 |

*Primary Examiner*—Kenneth J. Dorner
*Assistant Examiner*—Milton Nelson, Jr.

[57] ABSTRACT

A new and improved foldable stadium seat and storage apparatus includes a seat portion assembly, a storage assembly, and a first hinge assembly connecting the seat portion assembly and the storage assembly together. The first hinge assembly is connected between the interior side of the seat portion assembly and the interior side of the storage assembly. A strap is employed that is capable of encompassing the seat portion assembly and the storage assembly for retaining the interior side of the seat portion assembly and the interior side of the storage assembly in juxtaposition when the foldable stadium seat and storage apparatus is in a folded orientation. The seat portion assembly includes a first end proximal to the first hinge assembly, and a handle is connected to the first end of the seat portion assembly. The storage assembly includes a hollow chamber portion defined by rigid walls of the storage assembly. The storage assembly includes a cylindrical well portion for retaining a beverage can. The storage assembly also includes a first expandable storage chamber and a second expandable storage chamber. A back rest portion may be connected to a distal end of the seat portion assembly by a second hinge assembly.

7 Claims, 3 Drawing Sheets

FOLDABLE STADIUM SEAT AND STORAGE APPARATUS

BACKGROUND OF THE INVENTION

1. Field of the Invention

The present invention relates generally to portable seats that can be used in stadiums, and, more particularly, to a portable stadium seat that is foldable and has storage compartments.

2. Description of the Prior Art

Seats in many stadiums are comprised of hard wooden benches which may be uncomfortable for a number of reasons. The hardness and rigidity of the wood is uncomfortable. The wood may splinter causing injury to the person seated. The wood may be wet and, thereby, unsuitable for sitting upon. The wooden bench often does not include a back rest portion. For these reasons, portable stadium seats have been developed. A patron carries one's own portable stadium seat to the stadium for placement upon the hard wooden bench.

Throughout the years, a number of innovations have been developed relating to portable stadium seats, and the following U.S. patents are representative of some of those innovations: U.S. Pat. Nos. 4,715,652; 4,781,413; 4,871,209; 5,067,771; and Des. 258,178.

More specifically, U.S. Pat. No. 4,715,652 discloses a seat that is collapsible. That is the seat is disassembled for transportation and storage and reassembled in the stadium. Disassembly and reassembly may be a difficult and confusing task for many people. Moreover, once the parts are disassembled, they are susceptible to being separated from one another and lost. In this respect, it would be desirable if a stadium seat were provided which did not need to be disassembled for transportation and storage. The stadium seat disclosed in this patent has a retractable tray. However, except for the tray, the seat does not provide storage space for other items that a person may wish to have available in the stadium environment. Such other items include cans of beverages, magazines, a radio, and a blanket to mention just a few. In this respect, it would be desirable if a stadium seat were provided which included storage space for a variety of items.

U.S. Pat. No. 4,781,413 discloses a stadium seat that has a rigid frame in the form of a seat with a perpendicularly oriented back. The rigid nature of the frame impedes convenient transportation and storage. In this respect, it would be desirable if a stadium seat were provided which did not include a rigid frame that rigidly orients the back portion to the seat portion at a perpendicular orientation. A well is provided in the seat portion for receiving a beverage can. Another well is provided in the seat portion for retaining small items. However, the storage space is very limited and insufficient for retaining such items as magazines, a radio, and a blanket.

U.S. Pat. No. 4,871,209 discloses a folding stadium seat that includes hinges between the seat portion and the back portion. Essentially no storage space is provided with this device.

U.S. Pat. No. 5,067,771 discloses a folding stadium seat that has essentially no storage space for storing items. The back portion has a handle, and the seat portion has a handle. When the back portion is folded against the seat portion, the two handles are side by side and can be grasped simultaneously by a person carrying the folded seat. If one of the handles slips out of the person's grasp, the portion of the device that is not being carried by the handle may fall down under the influence of gravity. This situation may develop because the respective back portion and seat portion are located between the respective handles and the hinges between the back and seat portions. To avoid the possibility of gravity pulling open a folded stadium seat apparatus that is only partially supported by a holder's hand, it would be desirable if the respective back portion and seat portion are not located between respective handles and hinges connecting the back and seat portions to each other.

U.S. Pat. No. Des. 258,178 discloses another portable stadium seat. This device folds into a what may appear to be a brief case. A back rest is hingedly connected to the rear of the seat portion. A front hinged portion is hingedly connected to the front of the seat portion. Side bars or straps are used to support the back rest in a perpendicular orientation with respect to the seat portion. The side bars or straps may be undesirable because they may limit motion of the person sitting in the stadium seat. In this respect, it would be desirable if a stadium seat were provided which did not include side straps or bars for supporting a back rest in a perpendicular orientation with respect to the seat.

Still other features would be desirable in a foldable stadium seat and storage apparatus. For example, when the foldable stadium seat and storage apparatus is carried, it would be desirable if the force of gravity tends to keep the apparatus in a folded orientation. It would also be desirable if the foldable stadium seat and storage apparatus had expandable storage containers.

When a person sits on a stadium seat, the space between the front edge of the seat and the floor is usually not utilized. However, this space, just behind the person's legs that hang over the front edge of the seat, is readily accessible to the person sitting on the seat. In this respect, it would be desirable if a stadium seat were provided which utilizes the readily accessible space just behind a person's legs that hang over the front edge of the seat for storing items used by the person.

A perpendicular orientation of the back rest to the seat portion is important. In this respect, it would be desirable if a stadium seat were provided which automatically oriented the back rest to the seat portion in a perpendicular orientation when the seat portion is placed on the stadium bench.

Thus, while the foregoing body of prior art indicates it to be well known to use portable stadium seats, the prior art described above does not teach or suggest a foldable stadium seat and storage apparatus which has the following combination of desirable features: (1) does not need to be disassembled for transportation and storage; (2)includes storage space for a variety of items; (3) does not include a rigid frame that rigidly orients the back portion to the seat portion at a perpendicular orientation; (4) does not locate a respective back portion and a seat portion between respective handles and hinges which connect the back and seat portions to each other; (5) does not include side straps or bars for supporting a back rest in a perpendicular orientation with respect to the seat; (6) employs the force of gravity to tend to keep the apparatus in a folded orientation; (7) has expandable storage containers; (8) utilizes the readily accessible space just behind a person's legs that hang over the front edge of the seat for storing items used by the person; and (9) automatically orients the back rest to the seat portion in a perpendicular orientation when the seat portion is placed on the stadium bench. The foregoing desired characteristics are provided by the unique foldable stadium seat and storage apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved foldable stadium seat and storage apparatus which includes a seat portion assembly, a storage assembly, and a first hinge assembly connecting the seat portion assembly and the storage assembly together. The seat portion assembly includes an exterior side and an interior side. The storage assembly also includes an exterior side and an interior side. The first hinge assembly is connected between the interior side of the seat portion assembly and the interior side of the storage assembly. A strap is employed that is capable of encompassing the seat portion assembly and the storage assembly for retaining the interior side of the seat portion assembly and the interior side of the storage assembly in juxtaposition when the foldable stadium seat and storage apparatus is in a folded orientation.

The seat portion assembly includes a first end proximal to the first hinge assembly, and a handle is connected to the first end of the seat portion assembly.

The storage assembly includes a hollow chamber portion defined by rigid walls of the storage assembly. The storage assembly includes a cylindrical well portion for retaining a beverage can. The storage assembly also includes a first expandable storage chamber defined by the exterior side of the storage assembly, a first movable planar wall, and a pair of first expandable wails connected between the first movable planar wall and the exterior side of the storage assembly. The storage assembly also includes a second expandable storage chamber defined by the first movable planar wall, a second movable planar wail, and a pair of second expandable wails. The first expandable storage chamber and the second expandable storage chamber includes hook and loop fasteners for limiting expansion of the expandable chambers and for retaining items stored in the respective expandable containers.

A back rest portion may be connected to a distal end of the seat portion assembly by a second hinge assembly. The back rest portion includes a central planar portion substantially coextensive with the seat portion assembly. A pair of wing portions extend perpendicularly from edges of the central planar portion. The wing portions bracket the seat portion assembly. Each of the wing portions includes an aperture for receiving a pivot member connected to the seat portion assembly. The aperture and the pivot member comprise the second hinge assembly for connecting the back rest portion to the seat portion assembly.

The seat portion assembly may include a first cushion member, and the back rest portion includes a second cushion member. The first cushion member is frame shaped, and the second cushion member has a shape that is complementary to the frame-shaped first cushion member. In this respect, the second cushion member fits into the frame-shaped first cushion member when the back rest portion is folded up against the seat portion assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carded out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved foldable stadium seat and storage apparatus which has all of the advantages of the prior art and none of the disadvantages.

It is another object of the present invention to provide a new and improved foldable stadium seat and storage apparatus which may be easily and efficiently manufactured and marketed.

It is a further object of the present invention to provide a new and improved foldable stadium seat and storage apparatus which is of durable and reliable construction.

An even further object of the present invention is to provide a new and improved foldable stadium seat and storage apparatus which is susceptible of a low cost of manufacture with regard to both materials and labor, and which accordingly is then susceptible of low prices of sale to the consuming public, thereby making such foldable stadium seat and storage apparatus available to the buying public.

Still yet a further object of the present invention is to provide a new and improved foldable stadium seat and storage apparatus which does not need to be disassembled for transportation and storage.

Still another object of the present invention is to provide a new and improved foldable stadium seat and storage apparatus that includes storage space for a variety of items.

Yet another object of the present invention is to provide a new and improved foldable stadium seat and storage apparatus which does not include a rigid frame that rigidly orients the back portion to the seat portion at a perpendicular orientation.

Even another object of the present invention is to provide a new and improved foldable stadium seat and storage apparatus that does not locate a respective back portion and a seat portion between respective handles and hinges which connect the back and seat portions to each other.

Still a further object of the present invention is to provide a new and improved foldable stadium seat and storage apparatus which does not include side straps or bars for supporting a back rest in a perpendicular orientation with respect to the seat.

Yet another object of the present invention is to provide a new and improved foldable stadium seat and storage apparatus that employs the force of gravity to tend to keep the apparatus in a folded orientation.

An even further object of the present invention is to provide a now and improved foldable stadium seat and storage apparatus which has expandable storage containers.

Yet another object of the present invention is to provide a new and improved foldable stadium seat and storage apparatus that utilizes the readily accessible space just behind a person's legs that hang over the front edge of the seat for storing items used by the person.

Still a further object of the present invention is to provide a new and improved foldable stadium seat and storage apparatus that automatically orients the back rest to the seat portion in a perpendicular orientation when the seat portion is placed on the stadium bench.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved foldable stadium seat and storage apparatus embodying the principles and concepts of the present invention will be described.

Figure 1:
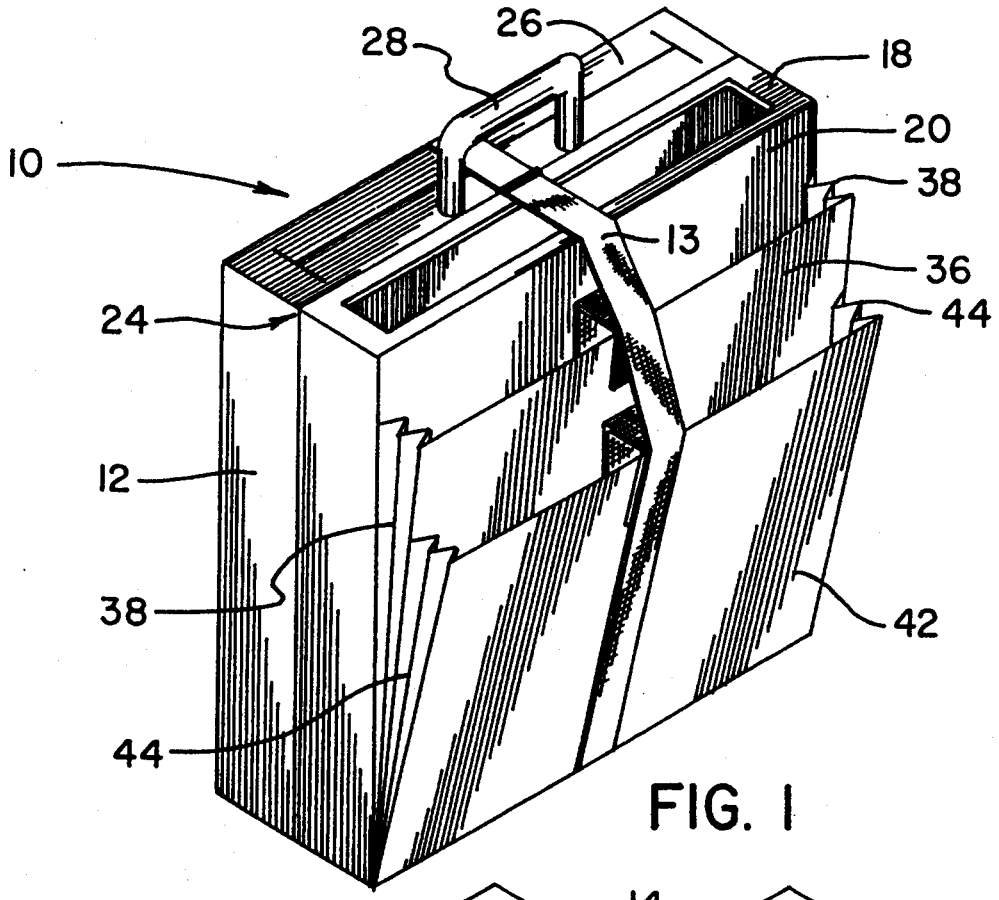
FIG. 1 is a perspective view showing a first preferred embodiment of the foldable stadium seat and storage apparatus of the invention in a folded up mode suitable for carrying.
Figure 2:
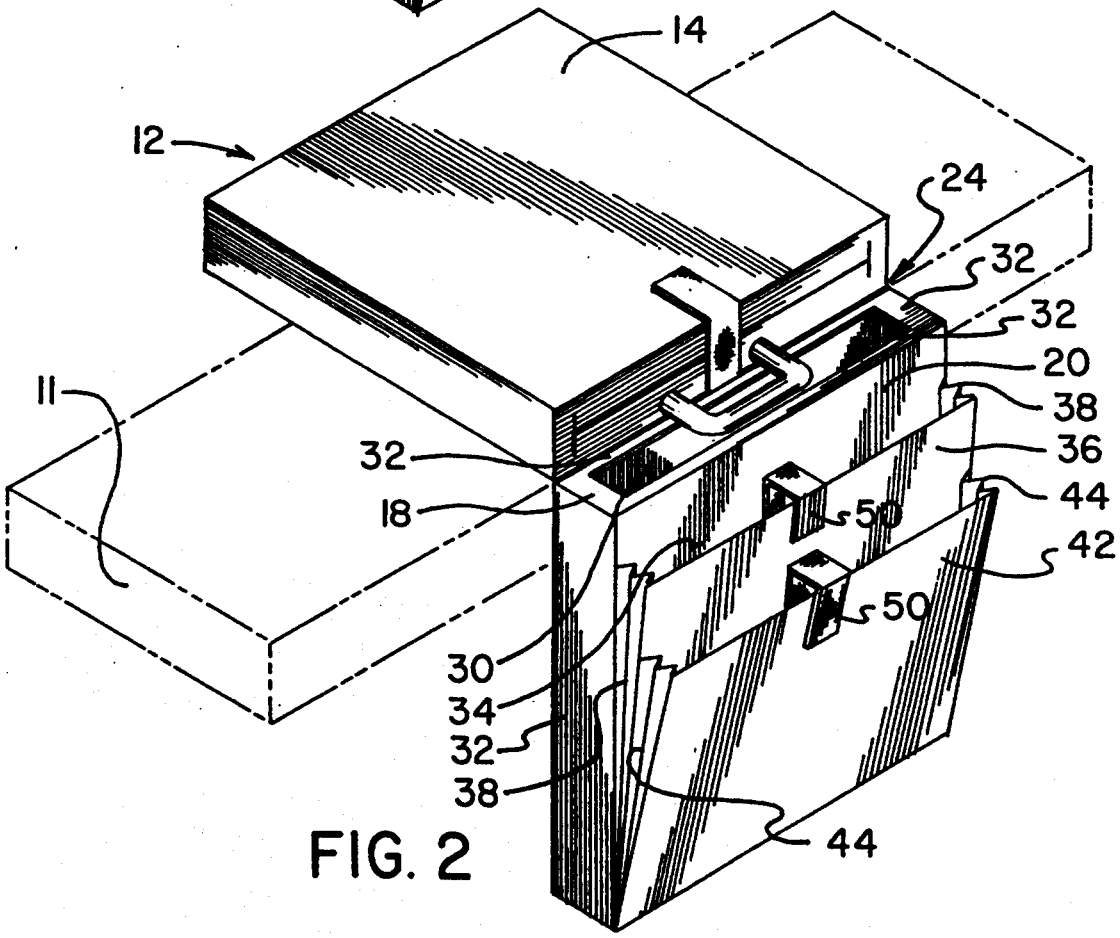
FIG. 2 is a perspective view of the foldable stadium seat and storage apparatus of FIG. 1 placed on a stadium bench with the seat portion supported by the bench and the storage portion hanging over the front edge of the bench.
Figure 3:
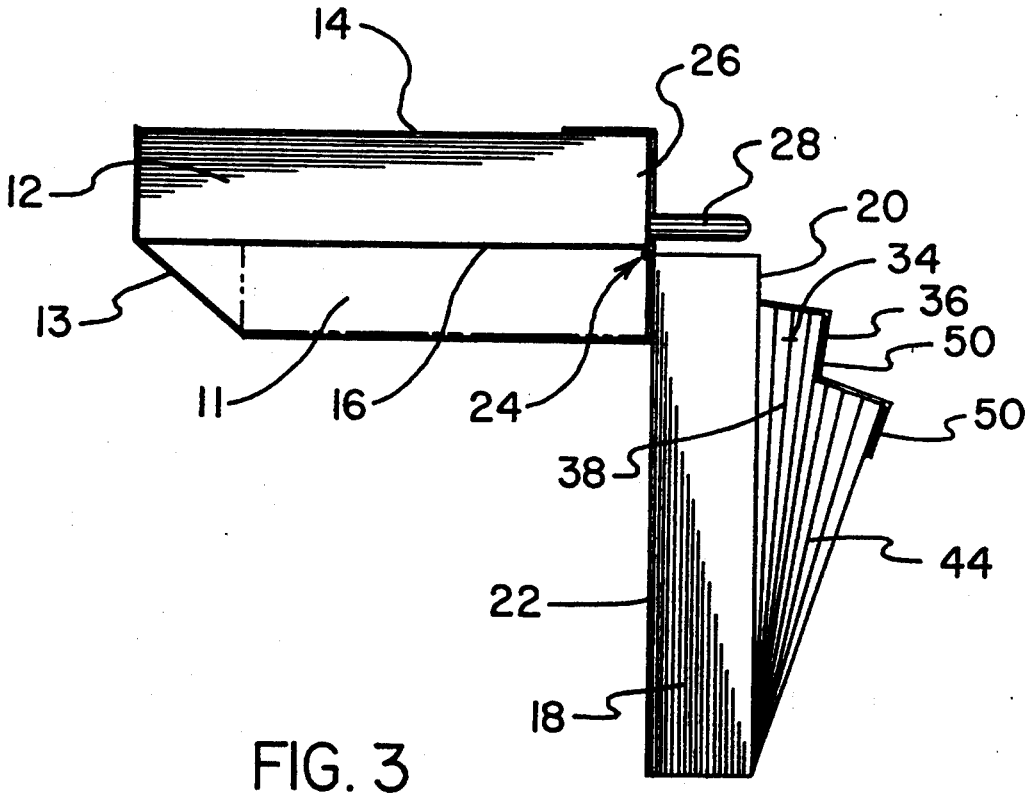
FIG. 3 is a side view of the foldable stadium seat and storage apparatus of FIG. 2.

Turning initially to FIGS. 1–3, there is shown a first exemplary embodiment of the foldable stadium seat and storage apparatus of the invention generally designated by reference numeral 10. In its preferred form, foldable stadium seat and storage apparatus 10 includes a seat portion assembly 12, a storage assembly 18, and a first hinge assembly 24 connecting the seat portion assembly 12 and the storage assembly 18 together. The seat portion assembly 12 includes an exterior side 14 and an interior side 16. The storage assembly 18 also includes an exterior side 20 and an interior side 22. The first hinge assembly 24 is connected between the interior side 16 of the seat portion assembly 12 and the interior side 22 of the storage assembly 18. The first hinge assembly 24 can be in a variety of forms which includes a hinge pin and hinge plates, a flexstyle cloth, and a flexible plastic film. Strap 13 is employed that is capable of encompassing the seat portion assembly 12 and the storage assembly 18 for retaining the interior side 16 of the seat portion assembly 12 and the interior side 22 of the storage assembly 18 in juxtaposition when the foldable stadium seat and storage apparatus 10 is in a folded orientation. The strap 13 can be secured around the seat portion assembly 12 and the storage assembly 18 using hook and loop connectors such as VELCRO (TM).

The seat portion assembly 12 includes a first end 26 proximal to the first hinge assembly 24, and a handle 28 is connected to the first end 26 of the seat portion assembly 12. The arrangement of the handle 28 proximal to the first hinge assembly 24 provides that the force of gravity causes the seat portion assembly 12 and the storage assembly 18 to automatically fold together under the influence of gravity when the foldable stadium seat and storage apparatus 10 of the invention is carried by the handle 28.

The storage assembly 18 includes a hollow chamber portion 30 defined by rigid walls 32 of the storage assembly 18. The storage assembly 18 includes a cylindrical well portion 48 for retaining a beverage can. The storage assembly 18 also includes a first expandable storage chamber 34 defined by the exterior side 20 of the storage assembly 18, a first movable planar wall 36, and a pair of first expandable walls 38 connected between the first movable planar wall 36 and the exterior side 20 of the storage assembly 18. The storage assembly 18 also includes a second expandable storage chamber 40 defined by the first movable planar wall 36, a second movable planar wall 42, and a pair of second expandable walls 44. The first expandable storage chamber 34 and the second expandable storage chamber 40 includes hook and loop fasteners 50 for limiting expansion of the expandable chambers and for retaining items stored in the respective expandable containers.

In use, the foldable stadium seat and storage apparatus 10 of the invention is carried by the handle 28 to a stadium bench 11. The interior side 16 of the seat portion assembly 12 is separated from the interior side 22 of the storage assembly 18 by rotating the storage assembly 18 away from the seat portion assembly 12 around the first hinge assembly 24. As shown in FIGS. 2 and 3, the interior side 16 of the seat portion assembly 12 is laid on top of the stadium bench 11, and the storage assembly 18 is permitted to hang over the front edge of the stadium bench 11. When a person sits upon the seat portion assembly 12, the storage assembly 18 hangs behind the person's legs. In this way, the hollow chamber portion 30, the first expandable storage chamber 34, and the second expandable storage chamber 40 are readily accessible to the person seated on the seat portion assembly 12.

Figure 4:
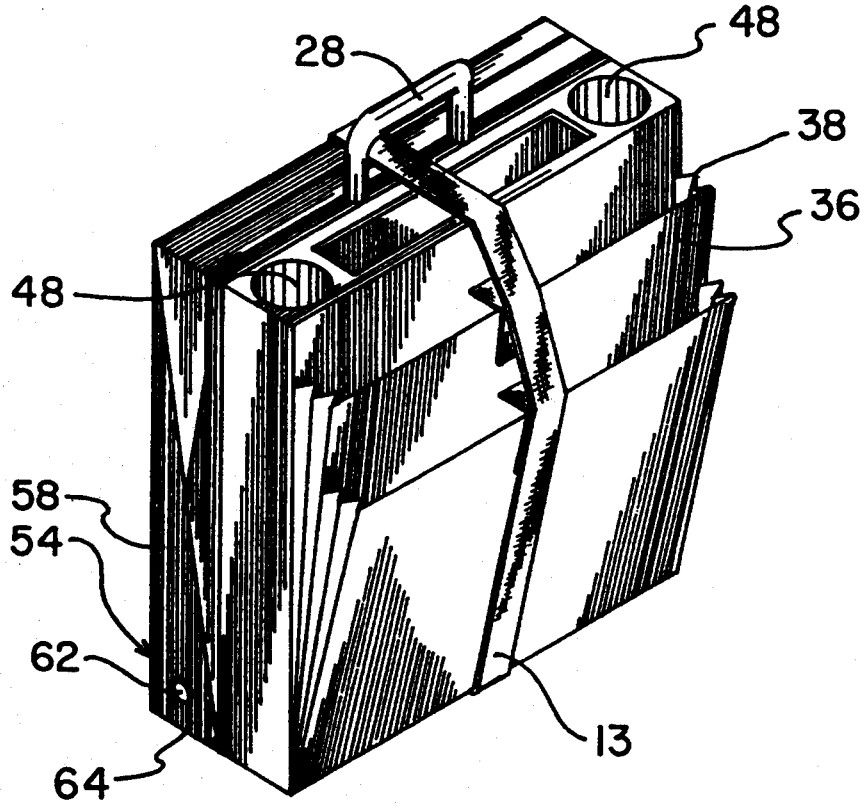
FIG. 4 is a perspective view of a second preferred embodiment of the foldable strum seat and storage apparatus of the invention which includes wells for receiving beverage cans and which includes a foldable back rest.
Figure 5:
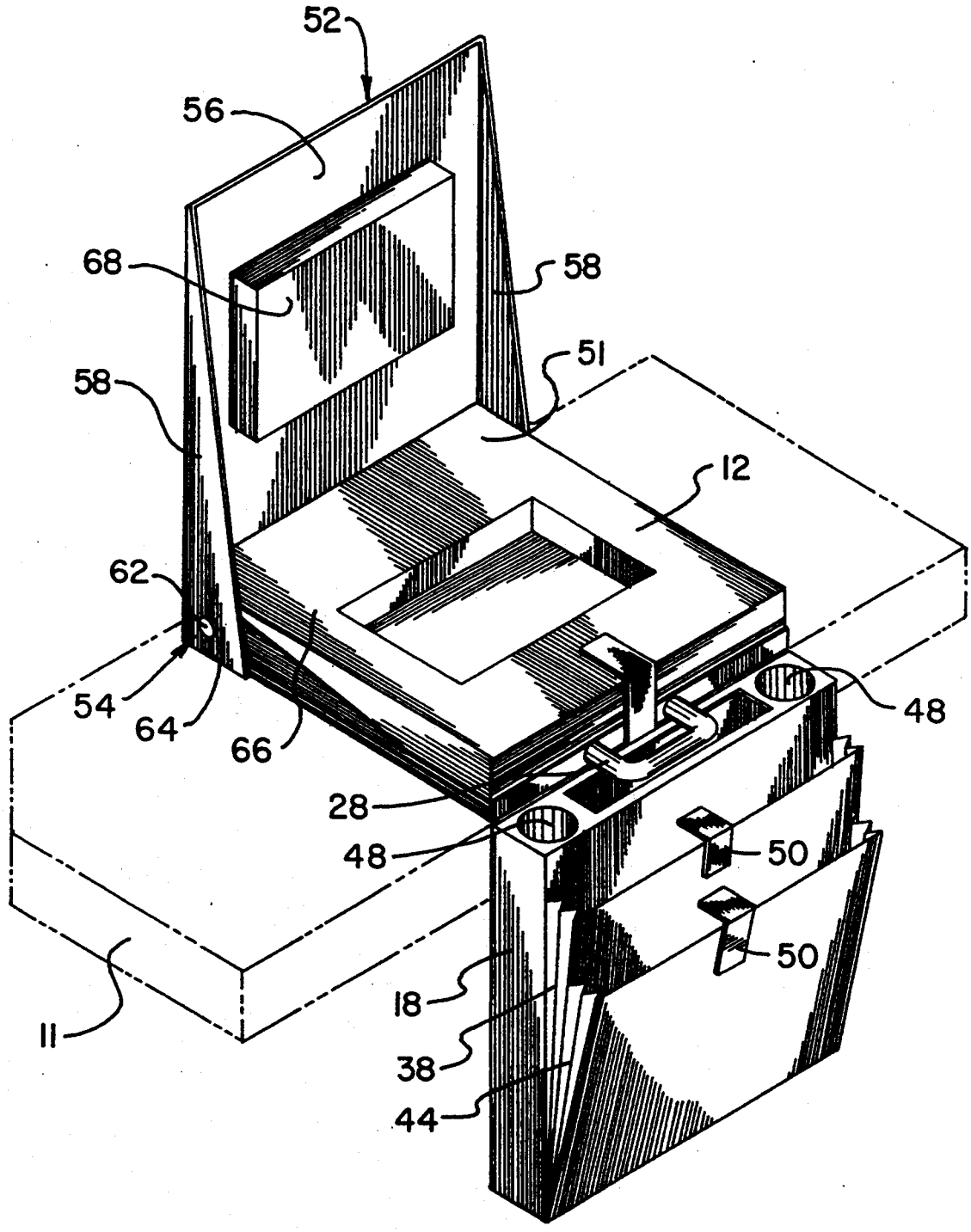
FIG. 5 is a perspective view of the foldable stadium seat and storage apparatus of FIG. 4 placed on a stadium bench with the seat portion supported by the bench, the back rest portion properly oriented by the stadium bench, and the storage portion hanging over the front edge of the bench.

Turning to FIGS. 4–5, a second embodiment of the invention is shown. Reference numerals are shown that correspond to like reference numerals that designate like elements shown in the other figures. In addition, a back rest portion 52 is connected to a distal end 51 of the seat portion assembly 12 by a second hinge assembly 54. The back rest portion 52 includes a central planar portion 56 substantially coextensive with the seat portion assembly 12. A pair of wing portions 58 extend perpendicularly from edges of the central planar portion 56. The wing portions 58 bracket the seat portion assembly 12. Each of the wing portions 58 includes an aperture 60 for receiving a pivot member 62 is connected to the seat portion assembly 12. The aperture 60 and the pivot member 62 comprise the second hinge assembly 54 for connecting the back rest portion 52 to the seat portion assembly 12.

As shown in FIG. 5, when the seat portion assembly 12 is placed on the stadium bench 11, the back rest portion 52 is unfolded to be perpendicular to the seat portion assembly 12. More specifically, the back rest portion 52 is rotated around pivot member 62 so that the bottom edge 64 is parallel to the interior side 16 of the seat portion assembly 12. In this way, the bottom edge 64 can be resting against the stadium bench 11. As a result, the central planar portion 56 of the back rest portion 52 is retained in a perpendicular orientation with respect to the seat portion assembly 12.

The seat portion assembly 12 includes a first cushion member 66, and the back rest portion 52 includes a second cushion member 68. The first cushion member 66 is frame shaped, and the second cushion member 68 has a shape that is complementary to the frame-shaped first cushion member 66. In this respect, the second cushion member 68 fits into the frame-shaped first cushion member 66 when the back rest portion 52 is folded up against the seat portion assembly 12.

The components of the foldable stadium seat and storage apparatus of the invention can be made from inexpensive and durable metal, cloth, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved foldable stadium seat and storage apparatus that is low in cost, relatively simple in design and operation, and which may advantageously be used to without needing to be disassembled for transportation and storage. With the invention, a foldable stadium seat and storage apparatus is provided which includes storage space for a variety of items. With the invention, a foldable stadium seat and storage apparatus is provided which does not include a rigid frame that rigidly orients the back portion to the seat portion at a perpendicular orientation. With the invention, a foldable stadium seat and storage apparatus is provided which does not locate a respective back portion and a seat portion between respective handles and hinges which connect the back and seat portions to each other. With the invention, a foldable stadium seat and storage apparatus is provided which does not include side straps or bars for supporting a back rest in a perpendicular orientation with respect to the seat. With the invention, a foldable stadium seat and storage apparatus is provided which employs the force of gravity to tend to keep the apparatus in a folded orientation. With the invention, a foldable stadium seat and storage apparatus is provided which has expandable storage containers. With the invention, a foldable stadium seat and storage apparatus is provided which utilizes the readily accessible space just behind a person's legs that hang over the front edge of the seat for storing items used by the person. With the invention, a foldable stadium seat and storage apparatus is provided which automatically orients the back rest to the seat portion in a perpendicular orientation when the seat portion is placed on the stadium bench.

With respect to the above description, it should be realized that the optimum dimensional relationships for the parts of the invention (which include variations in size, form, function, manner of operation, assembly, and use) are deemed readily apparent and obvious to those skilled in the art. Therefore, all relationships equivalent to those illustrated in the drawings and described in the specification are intended to be limited only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved foldable stadium seat and storage apparatus, comprising:

a seat portion assembly which includes an exterior side and an interior side, a storage assembly which includes an exterior side and an interior side, a first expandable storage chamber defined by said exterior side of said storage assembly, a first movable planar wall, and a pair of first expandable walls connected between said first movable planar wall and said exterior side of said storage assembly, a second expandable storage chamber defined by said first movable planar wall, a second movable planar wall, and a pair of second expandable walls, and a first hinge assembly for connecting said storage assembly to said seat portion assembly, said first hinge assembly connected between said interior side of said seat portion assembly and said interior side of said storage assembly.

2. The apparatus described in claim 1 wherein said first expandable storage chamber and said second expandable storage chamber include hook and loop fasteners for limiting expansion of said expandable chambers.

3. The apparatus described in claim 1, further including:

a back rest portion connected to a distal end of said seat portion assembly by a second hinge assembly.

4. The apparatus described in claim 1 further including:

a strap capable of encompassing said seat portion assembly and said storage assembly for retaining said interior side of said seat portion assembly and said interior side of said storage assembly in juxtaposition when said foldable stadium seat and storage apparatus is in a folded orientation.

5. The apparatus described in claim 1 wherein said seat portion assembly includes a first end proximal to said first hinge assembly, and, further including:

a handle connected to said first end of said seat portion assembly.

6. The apparatus described in claim 1 wherein said storage assembly includes:

a hollow chamber portion defined by rigid walls of said storage assembly.

7. The apparatus described in claim 1 wherein said storage assembly includes:

a cylindrical well portion for retaining a beverage can.

* * * * *